US009477172B1

(12) United States Patent
Ota

(10) Patent No.: US 9,477,172 B1
(45) Date of Patent: Oct. 25, 2016

(54) DEVELOPING DEVICE AND IMAGE FORMING APPARATUS COMPRISING THE SAME

(71) Applicant: FUJI XEROX CO., LTD., Tokyo (JP)

(72) Inventor: Daisuke Ota, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/943,875

(22) Filed: Nov. 17, 2015

(30) Foreign Application Priority Data

Jun. 25, 2015 (JP) ..... 2015-128027

(51) Int. Cl.
*G03G 15/06* (2006.01)

(52) U.S. Cl.
CPC ..... *G03G 15/065* (2013.01)

(58) Field of Classification Search
CPC ..... G03G 15/065
See application file for complete search history.

(56) References Cited

U.S. PATENT DOCUMENTS 7,254,350 B2 8/2007 Kawamura et al.
2009/0304414 A1* 12/2009 Hamada ..... G03G 15/065 399/270
2012/0201551 A1* 8/2012 Kato ..... G03G 15/065 399/44

FOREIGN PATENT DOCUMENTS

JP S63-60160 U 4/1988
JP 2005-234238 A 9/2005

* cited by examiner

*Primary Examiner* — Rodney Bonnette
(74) *Attorney, Agent, or Firm* — Oliff PLC

(57) ABSTRACT

An image forming apparatus includes an image carrier, a developing part that develops an electrostatic latent image formed on the image carrier by using toner, a supply part that supplies a developing bias between the image carrier and the developing part, the developing bias having an AC component superimposed on a DC component, and a setting part that sets a peak-to-peak value of the AC component of the developing bias to vary between a reference value that is determined in advance and a special value smaller than the reference value when an image region on the image carrier passes through a developing region, the image region being a region on the image carrier in which an image is to be formed, the developing region being a region in which the image carrier is opposed to the developing part.

11 Claims, 13 Drawing Sheets

DEVELOPING DEVICE AND IMAGE FORMING APPARATUS COMPRISING THE SAME

CROSS-REFERENCE TO RELATED APPLICATIONS

This application is based on and claims priority under 35 USC 119 from Japanese Patent Application No. 2015-128027 filed Jun. 25, 2015.

BACKGROUND

Technical Field

The present invention relates to an image forming apparatus and an image forming method.

SUMMARY

According to an aspect of the invention, there is provided an image forming apparatus including an image carrier, a developing part that develops an electrostatic latent image formed on the image carrier by using toner, a supply part that supplies a developing bias between the image carrier and the developing part, the developing bias having an AC component superimposed on a DC component, and a setting part that sets a peak-to-peak value of the AC component of the developing bias to vary between a reference value that is determined in advance and a special value smaller than the reference value when an image region on the image carrier passes through a developing region, the image region being a region on the image carrier in which an image is to be formed, the developing region being a region in which the image carrier is opposed to the developing part.

BRIEF DESCRIPTION OF THE DRAWINGS

Exemplary embodiments of the present invention will be described in detail based on the following figures, wherein.

DETAILED DESCRIPTION

Hereinafter, exemplary embodiments of the present invention will be described in detail with reference to the attached figures.

Exemplary Embodiment 1

Figure 1:
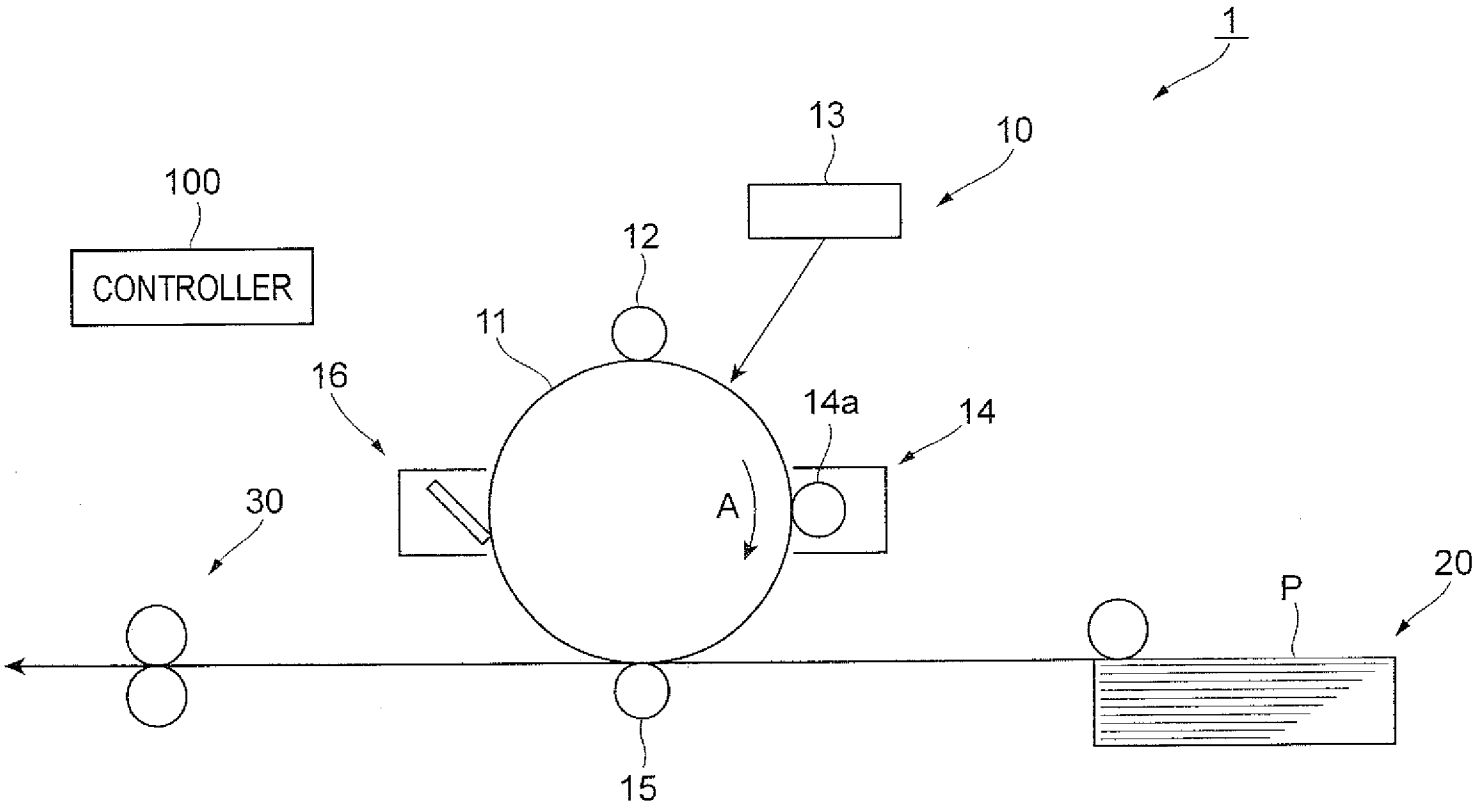
FIG. 1 illustrates a general configuration of an image forming apparatus according to an exemplary embodiment.

FIG. 1 illustrates a general configuration of an image forming apparatus 1 according to an exemplary embodiment.

The image forming apparatus 1 includes an image forming part 10, a paper supply part 20, a fixing part 30, and a controller 100. The image forming part 10 forms a single-color (for example, black) toner image by the electrophotographic system. The paper supply part 20 supplies paper P toward the image forming part 10. The fixing part 30 fixes an image (toner image) that is formed on the paper P by the image forming part 10. The controller 100 controls operation of various parts of the image forming apparatus 1.

The image forming part 10 has a photoconductor drum 11 that is rotatable in the direction indicated by an arrow A in FIG. 1. The image forming part 10 also has a charging roller 12, an exposure device 13, a developing device 14, a transfer roller 15, and a cleaning device 16, which are provided around the photoconductor drum 11 along the direction indicated by the arrow A.

The photoconductor drum 11 as an example of an image carrier has an organic photosensitive layer (not illustrated) formed on the surface of a thin-walled cylindrical drum made of metal. In this example, the organic photosensitive layer is made of a material that is charged to a negative polarity. Further, the photoconductor drum 11 is grounded.

The charging roller 12 is formed by, for example, a rubber roller having electrical conductivity. Further, the charging roller 12 is disposed so as to be rotatable while in contact with the photoconductor drum 11. The charging roller 12 rotates as the photoconductor drum 11 rotates. A charging bias for charging the photoconductor drum 11 to a negative potential is applied to the charging roller 12.

The exposure device 13 uses, for example, laser light to selectively perform optical writing on the photoconductor drum 11 that has been charged to a negative potential by the charging roller 12, thereby forming an electrostatic latent image on the photoconductor drum 11. At this time, the exposure device 13 according to Exemplary Embodiment 1 performs exposure by a so-called image portion exposure system, in which an area (image portion) that is to become a toner image (image) is irradiated with light, and an area (background portion) that is to become the background is not irradiated with light. Other than a laser light source, a light emitting diode (LED) light source may be used as a light source in the exposure device 13.

The developing device 14 as an example of a developing part includes a developing roller 14*a* that is rotatably disposed so as to be opposed to the photoconductor drum 11. The developing device 14 contains a developer including a toner of a predetermined color (black in this example). As the developer, the developing device 14 uses a so-called two-component developer including a carrier having magnetic property, and a toner that is colored in a predetermined color in advance. In the developer, the carrier has a positive charge polarity, and the toner has a negative charge polarity. The developing roller 14*a* has a built-in magnet (not illustrated) so that the carrier with the toner adhered thereto by an electrostatic force, that is, the developer, is held on the surface of the developing roller 14*a* by a magnetic force exerted by the magnet. The developing device 14 develops an electrostatic latent image on the photoconductor drum 11 by using the developer (toner) held on the developing roller 14*a*. The developing device 14 develops an image by a so-called reversal development system, in which a developing bias for placing a negative potential on the developing roller 14*a* is supplied to transfer the negatively charged toner to the image portion that is the negatively charged portion of the electrostatic latent image. In Exemplary Embodiment 1, a developing bias including a direct current (DC) component and an alternating current (AC) component is supplied to the developing roller 14*a*. A detailed description of the developing bias will be given later. Further, in the following description, a region where the photoconductor drum 11 and the developing roller 14*a* are opposed to each other will be referred to as developing region.

The transfer roller 15 is formed by, for example, a rubber roller having electrical conductively. The transfer roller 15, which is disposed in contact with the photoconductor drum 11, rotates as the photoconductor drum 11 rotates. A transfer bias having a polarity (positive polarity in this example) opposite to the polarity of the charge on the toner is applied to the transfer roller 15.

The cleaning device 16 includes, for example, a blade member disposed in contact with the photoconductor drum 11. The cleaning device 16 removes deposits (such as toner) that are present on the photoconductor drum 11 after transfer and before charging.

The paper supply part 20 includes, for example, a storage container that stores paper P, and a feed mechanism that feeds the paper P from the storage container. The paper supply part 20 also has, for example, a transport mechanism that transports the paper P that has been fed, to the outside via a transfer part in which the photoconductor drum 11 and the transfer roller 15 are opposed to each other, and via the fixing part 30.

The fixing part 30 includes a pair of rotating bodies that rotate while in contact with each other. In the fixing part 30, at least one of the two rotating bodies is heated, and the paper P is passed through a fixing nip part defined between the two rotating bodies.

Figure 2:
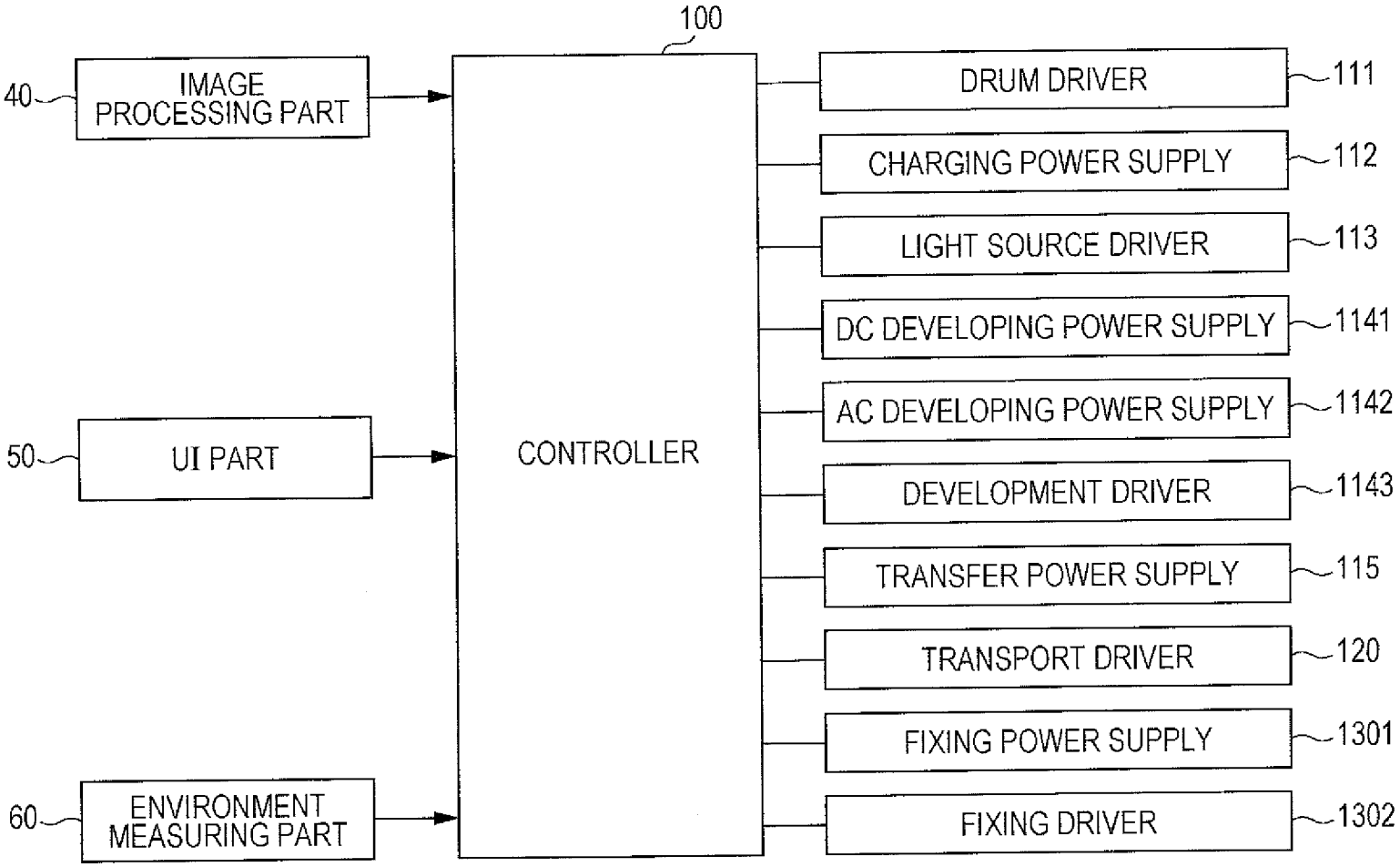
FIG. 2 is a block diagram illustrating a configuration of a control system in an image forming apparatus.

FIG. 2 is a block diagram illustrating a configuration of a control system in the image forming apparatus 1 according to Exemplary Embodiment 1.

The controller 100 includes a central processing unit (CPU) that reads and executes a program, a read only memory (ROM) that stores, for example, a program executed by the CPU and data used when executing the program, and a random access memory (RAM) that stores, for example, data temporarily generated when executing a program (all of these components are not illustrated).

The controller 100 receives an input of image data that has undergone image processing, from an image processing part 40 that applies various image processing on image data input from a computer apparatus or a scanner apparatus (both not illustrated). Further, the controller 100 receives an input of setting instruction data from the user via a user interface part (UI part) 50 that receives an operation made by the user. Further, the controller 100 receives an input of environment measurement data from an environment measuring part 60 that measures the environment (for example, temperature and humidity) in which the image forming apparatus 1 is placed. In this example, the image processing part 40, the UI part 50, and the environment measuring part 60 are provided inside the image forming apparatus 1.

The controller 100 outputs a control signal to each of a drum driver 111 that rotationally drives the photoconductor drum 11, a charging power supply 112 that supplies a charging bias to the charging roller 12, and a light source driver 113 that drives a light source provided in the exposure device 13. The controller 100 also outputs a control signal to each of a DC developing power supply 1141 that supplies a DC developing bias to the developing roller 14*a* provided in the developing device 14, an AC developing power supply 1142 that supplies an AC developing bias to the developing roller 14*a*, and a development driver 1143 that rotationally droves the developing roller 14*a*. Further, the controller 100 outputs a control signal to each of a transfer power supply 115 that supplies a transfer bias to the transfer roller 15, and a transport driver 120 that drives a transport system that transports the paper P, including the paper supply part 20. Furthermore, the controller 100 outputs a control signal to each of a fixing power supply 1301 that supplies heating electric power to the rotating bodies of the fixing part 30, and a fixing driver 1302 that rotationally drives the rotating bodies of the fixing part 30.

In this example, the charging power supply 112 supplies a charging bias to the charging roller 12. The charging bias includes an AC component superimposed on a DC component that is set to a negative value. In the following description, the DC component of the charging bias will be referred to as DC charging bias, and the AC component of the charging bias will be referred to as AC charging bias. The DC charging bias is used to charge the organic photosensitive layer provided on the photoconductor drum 11 to a target potential (referred to as charging potential), and the AC charging bias is used to aid in the charging of the organic photosensitive layer by the DC charging bias.

In this example, the DC developing power supply 1141 supplies a DC developing bias including a DC component set to a negative value, to the developing roller 14*a*. The AC developing power supply 1142 supplies an AC developing bias including an AC component to the developing roller 14*a*. The DC developing bias is used to move toner from the developing roller 14*a* to the organic photosensitive layer (more specifically, the image portion) provided on the photoconductor drum 11, and the AC developing bias is used to vibrate toner to aid in the movement of toner from the developing roller 14*a* to the inorganic photosensitive layer by the DC developing bias.

In Exemplary Embodiment 1, the controller 100 controls the transfer bias supplied from the transfer power supply 115 to the transfer roller 15 to a constant current or constant voltage. While the transfer bias may be basically any bias including a DC component, the transfer bias may further include an AC component superimposed on the DC component.

In Exemplary Embodiment 1, the DC developing power supply 1141 and the AC developing power supply 1142 both function as an example of a supply part. Further, in Exemplary Embodiment 1, the controller 100 functions as an example of a setting part or a changing part.

Figure 3:
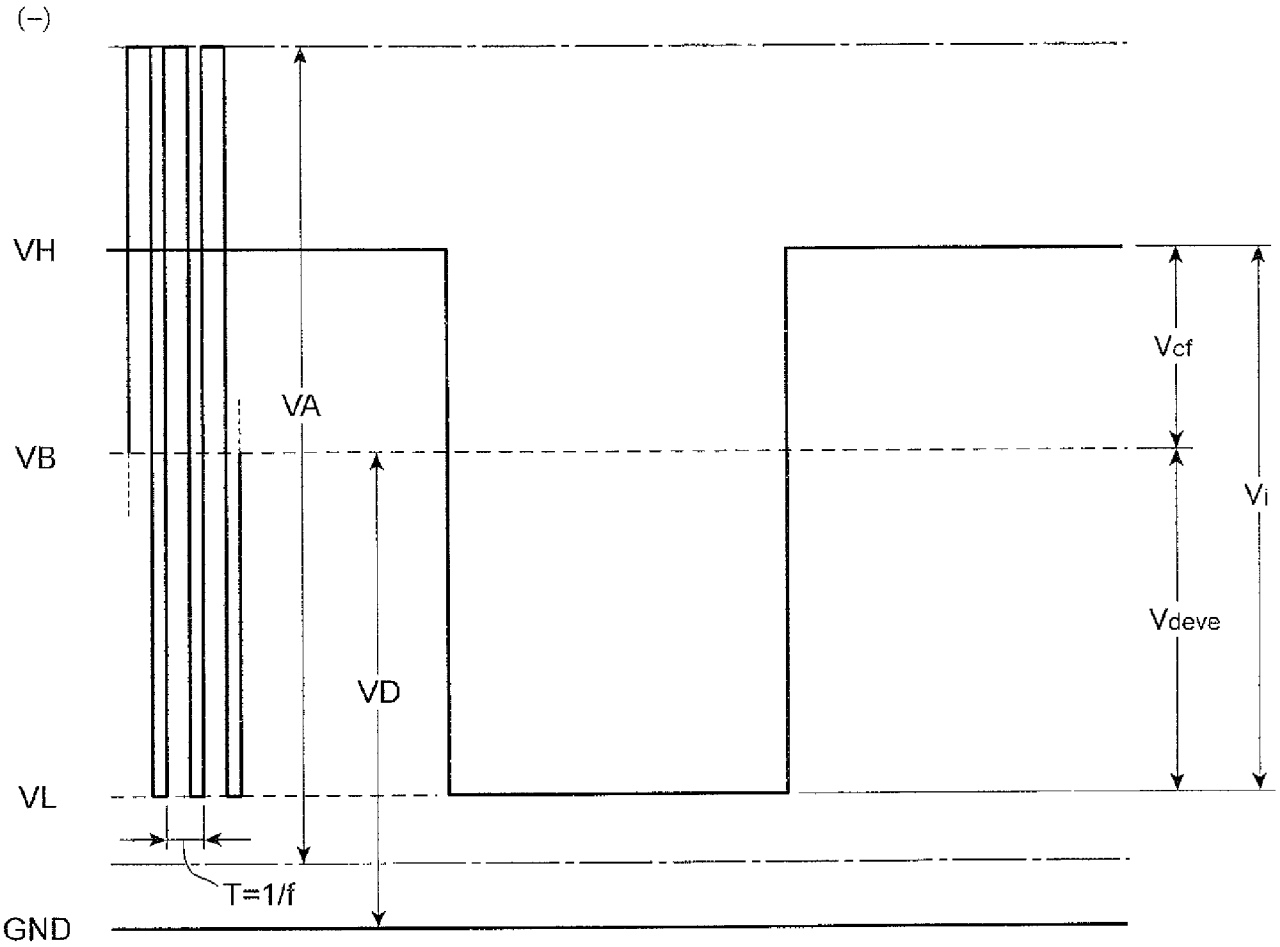
FIG. 3 illustrates the relationship between a charging potential and an exposure potential in a photoconductor drum, and a developing potential in a developing device.

FIG. 3 illustrates the relationship between a charging potential VH and an exposure potential VL in the photoconductor drum 11, and a developing potential VB in the developing device 14 (more specifically, the developing roller 14*a*). In FIG. 3, the horizontal axis represents a position on the photoconductor drum 11, and the vertical axis represents potential (the bottom being the ground (GND); the higher along the vertical axis, the higher the value of negative potential). The charging potential VH is determined by the magnitude of a DC charging bias of the charging bias mentioned above, and the exposure potential VL is determined by the charging bias and the energy of exposure by the exposure device 13. Further, the developing potential VB is determined by the magnitude of a DC developing bias VD of the developing bias mentioned above. FIG. 3 also depicts the magnitude of the AC developing bias VA of the developing bias. Since the AC developing bias VA is an AC bias, its magnitude is represented by a peak-to-peak value.

In Exemplary Embodiment 1, the charging potential VH and the exposure potential VL both have a negative polarity. The magnitude of the exposure potential VL is less than that of the charging potential VH in absolute value ($|VL|<|VH|$). Further, the developing potential VB, that is, the DC developing bias VD according to Exemplary Embodiment 1 has a negative polarity, and its absolute value is set to a magnitude between the charging potential VH and the exposure potential VL ($|VL|<|VB|<|VH|$).

When the charging potential VH, the exposure potential VL, and the developing potential VB have the relationship mentioned above, as the toner (charged to a negative potential) on the developing roller 14*a* passes through the developing region, the toner readily moves (flies) to the region of the exposure potential VL (image portion) which is a region at a relatively positive potential on the photoconductor drum 11, but the toner does not readily move (fly) to the region of the charging potential VH (background portion) which is a region at a relatively negative potential on the photoconductor drum 11. Conversely to the toner, as the carrier (charged to a positive potential) on the developing roller 14*a* passes through the developing region, the carrier does not readily move (fly) to the region of the exposure potential VL (image portion) which is a region at a relatively positive potential on the photoconductor drum 11, but the carrier readily moves (flies) to the region of the charging potential VH (background portion) which is a region at a relatively negative potential on the photoconductor drum 11. However, the carrier of the developer is magnetically held on the developing roller 14*a*, and hence there is hardly any movement of the carrier in actuality. In the following description, with the ease of flight of the toner taken as a criterion, the difference between the exposure potential VL and the developing potential VB with reference to the exposure potential VL will be referred to as flight potential difference Vdeve, and the difference between the developing potential VB and the charging potential VH with reference to the developing potential VB will be referred to as reverse flight potential difference Vcf. Further, the difference between the exposure potential VL and the charging potential VII with reference to the exposure potential VL will be referred to as latent image potential difference Vi. The latent image potential difference Vi may be expressed as the sum of the flight potential difference Vdeve and the reverse flight potential difference Vcf.

In this example, the AC developing bias VA is supplied as a rectangular wave. Accordingly, in addition to the peak-to-peak value and period of the AC developing bias VA, its duty ratio may be also adjusted. In the following description, the period of the AC developing bias VA will be referred to as developing bias period T, and the reciprocal (=1/T) of the developing bias period T will be referred to as developing bias frequency f.

Next, a description will be given of an image forming operation that forms an image on the paper P by using the image forming apparatus 1 illustrated in FIG. 1.

In the image forming part 10, the photoconductor drum 11 that rotates in the direction indicated by the arrow A is charged to the charging potential VH by a charging bias supplied to the charging roller 12 that contacts the photoconductor drum 11. Next, exposure by the exposure device 13 is started. The photoconductor drum 11, which rotates while being charged to the charging potential VH, has its image portion selectively exposed to light emitted from the exposure device 13. As a result, an electrostatic latent image is formed on the organic photosensitive layer that has been charged and exposed as mentioned above, with the background portion being at the charging potential VH and the image portion being at the exposure potential VL.

Subsequently, as the photoconductor drum 11 rotates, the electrostatic latent image formed on the photoconductor drum 11 reaches the developing region opposed to the developing roller 14*a* provided in the developing device 14. At this time, the developing roller 14*a*, which is rotating with the developer including carrier and toner held on its surface, is set to the developing potential VB by the DC developing bias VD supplied to the developing roller 14*a*. This causes toner to selectively move from the developing roller 14*a* to the image portion of the electrostatic latent image on the photoconductor drum 11 which is at the exposure potential VL. As a result, a toner image corresponding to the electrostatic latent image is developed on the photoconductor drum 11 that has passed through the developing region. In the meantime, the AC developing bias VA is also supplied to the developing roller 14*a*. The AC developing bias VA causes the toner existing in the developing region to vibrate, thus aiding in the movement of a toner image.

As the photoconductor drum 11 rotates, the toner image developed on the photoconductor drum 11 as described above moves toward a transfer position opposed to the transfer roller 15. Meanwhile, the paper P drawn out from the paper supply part 20 is transported to the transfer position by the transport mechanism (not illustrated), in synchronism with the timing at which the toner image on the photoconductor drum 11 reaches the transfer position.

Thereafter, as the photoconductor drum 11 rotates, the toner image developed on the photoconductor drum 11 reaches the transfer position opposed to the transfer roller 15. At this time, as the transfer bias is supplied to the transfer roller 15, the toner image formed on the photoconductor drum 11 is transferred (electrostatically transferred) onto the paper P that passes through the transfer position. As the photoconductor drum 11 further rotates, deposits such as toner remaining on the photoconductor drum 11 after the transfer reach the portion of the photoconductor drum 11 which is opposed to the cleaning device 16, and are removed by the cleaning device 16.

In Exemplary Embodiment 1, an operation mode (referred to as developing mode) of the developing device 14 during an image forming operation includes a normal mode and a power saving mode (eco-mode). The normal mode is a mode that gives higher priority to image quality than to reduction of power consumption. The power saving mode is a mode that gives higher priority to reduction of power consumption than to image quality. On the basis of an instruction received from the user, an image forming operation is executed in one of the normal mode and the power saving mode. In Exemplary Embodiment 1, the normal mode corresponds to a first mode, and the power saving mode corresponds to a second mode.

Figure 4:
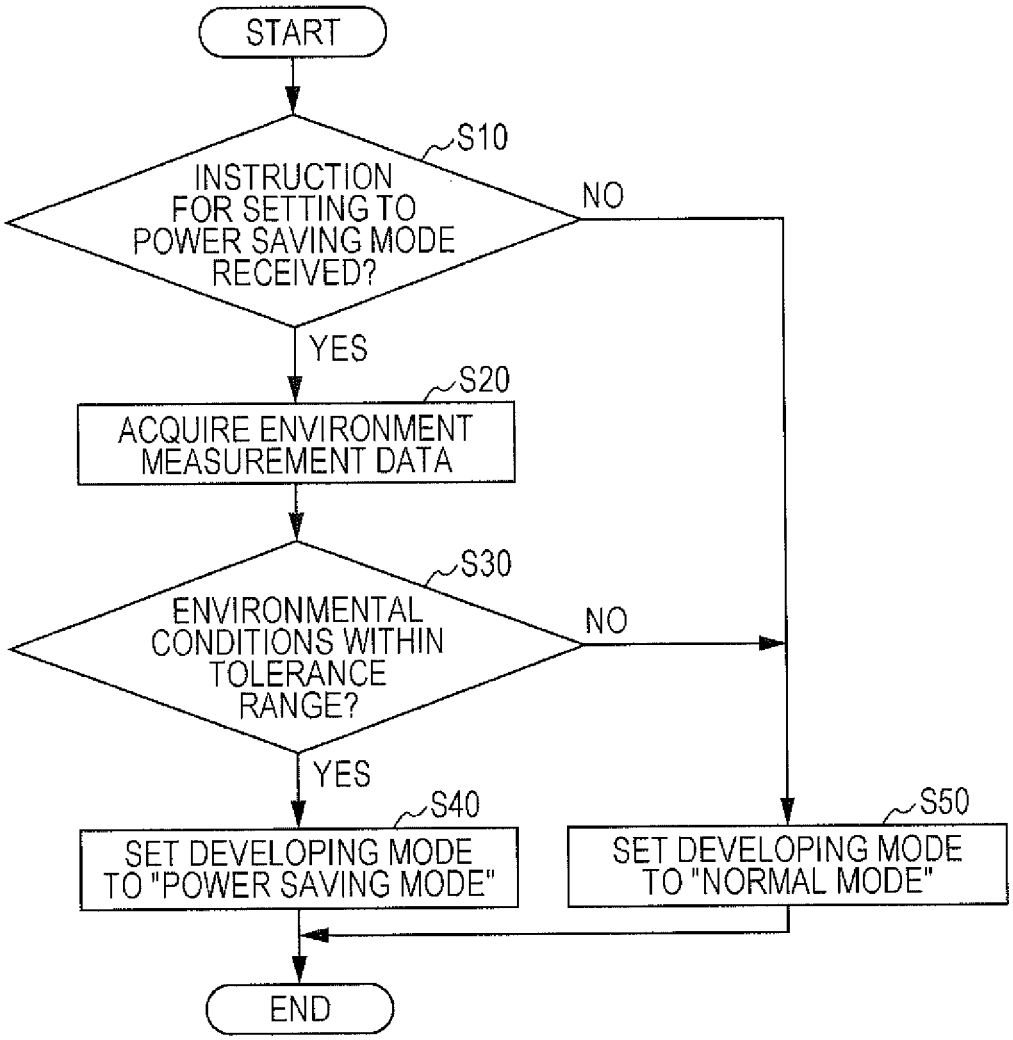
FIG. 4 is a flowchart illustrating a procedure for setting a developing mode in an image forming operation.

FIG. 4 is a flowchart illustrating a procedure for setting a developing mode in an image forming operation according to Exemplary Embodiment 1.

In this process, first, the controller 100 determines if an instruction for setting the developing mode to the power saving mode has been received from the user via the UI part 50 (step 10). If a positive determination (YES) is made at step 10, the controller 100 then acquires environment measurement data including temperature and humidity from the environment measuring part 60 (step 20). Subsequently, on the basis of the environment measurement data acquired at step 20, the controller 100 determines if the current environmental conditions including temperature and humidity are within a predetermined tolerance range (step 30). At step 30, a temperature higher or lower than normal or a humidity higher or lower than normal is regarded as outside the tolerance range, and hence a negative determination (NO) is made. If a positive determination (YES) is made at step 30, the controller 100 sets the developing mode of the developing device 14 to "power saving mode" (step 40), and completes this process. If a negative determination (NO) is made at step 10, and if a negative determination (NO) is made at step 30, the controller 100 sets the developing mode of the developing device 14 to "normal mode" (step 50), and completes this process. Then, with the developing mode of the developing device 14 being set to "power saving mode" or "normal mode", the controller 100 waits until it is instructed to start an image forming operation.

The developing mode according to Exemplary Embodiment 1 will be described in more detail below.

Figure 5A:
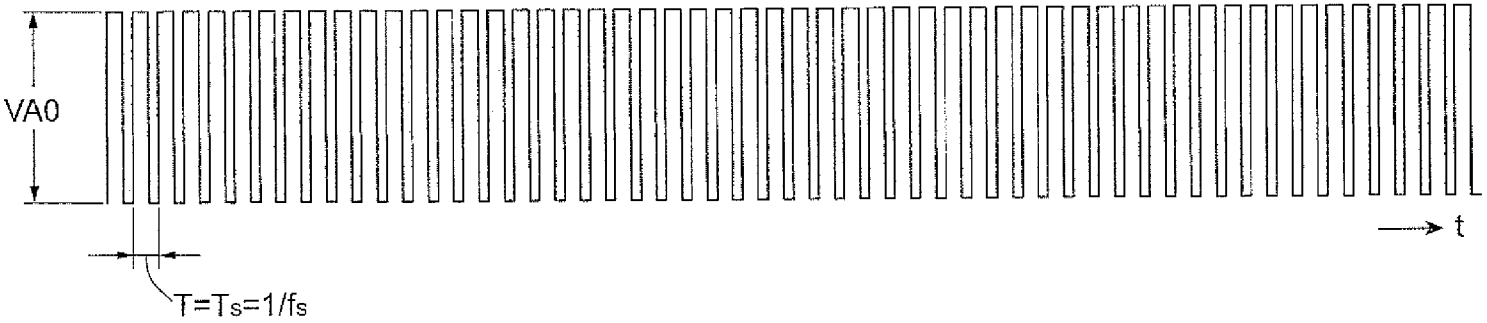
FIG. 5A illustrates an example of a waveform of a normal AC developing bias used as an AC developing bias in normal mode according to Exemplary Embodiment 1.
Figure 5B:
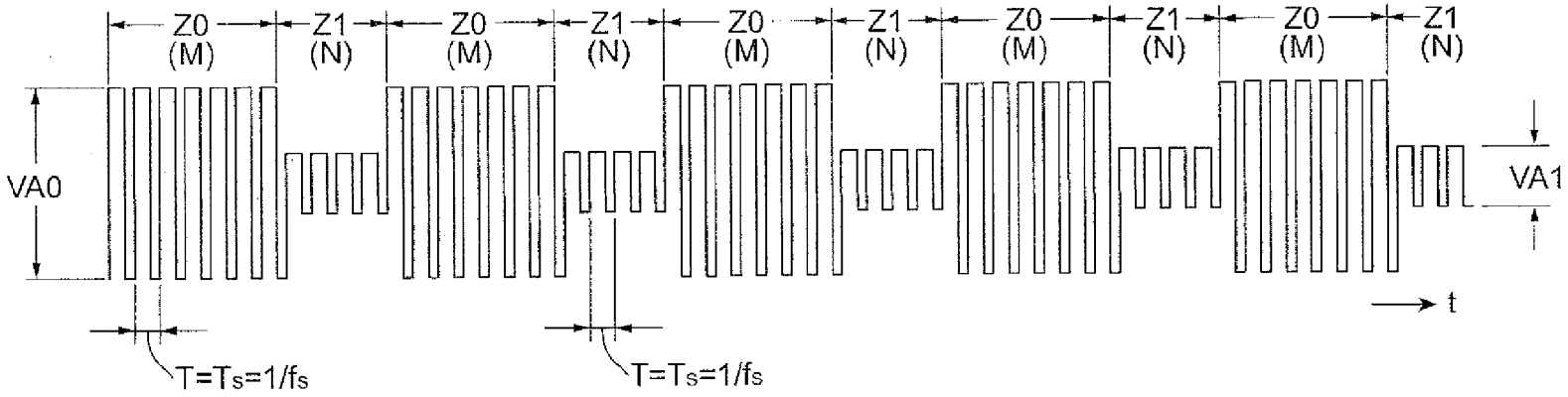
FIG. 5B illustrates an example of a waveform of a power-saving AC developing bias used as an AC developing bias in power saving mode according to Exemplary Embodiment 1.

FIG. 5A illustrates an example of a waveform of a normal AC developing bias VAs used as the AC developing bias VA in normal mode according to Exemplary Embodiment 1. FIG. 5B illustrates an example of a waveform of a power-saving AC developing bias VAr used as the AC developing bias VA in power saving mode according to Exemplary Embodiment 1. In FIGS. 5A and 5B, the horizontal axis represents elapse of time t, and the vertical axis represents the magnitude (peak-to-peak value) of the AC developing bias VA.

First, the normal AC developing bias VAs will be described with reference to FIG. 5A.

The normal AC developing bias VAs illustrated in FIG. 5A is formed by a rectangular wave with a peak-to-peak value that is uniformly set to an AC reference value VA0. The developing bias period T of the normal AC developing bias VAs is set to a reference period Ts. As a result, the developing bias frequency f of the normal AC developing bias VAs is a reference frequency fs that is the reciprocal of the reference period Ts.

Next, the power-saving AC developing bias VAr will be described with reference to FIG. 5B.

The power-saving AC developing bias VAr illustrated in FIG. 5B alternates between a reference output period Z0 and a special output period Z1. In the reference output period Z0, a rectangular wave whose peak-to-peak value is set to the AC reference value VA0 (an example of a reference value) is output. In the special output period Z1, a rectangular wave whose peak-to-peak value is set to an AC special value VA1 (an example of a special value: VA1 <VA0) smaller than the AC reference value VA0 is output. In this example, the reference output period Z0 is set longer than the special output period Z1 (Z0>Z1). The developing bias period T of the power-saving AC developing bias VAr is set to the reference period Ts for both the reference output period Z0 and the special output period Z1. As a result, the developing bias frequency f of the power-saving AC developing bias VAr is also the reference frequency fs that is the reciprocal of the reference period Ts for both the reference output period Z0 and the special output period Z1. Further, for the power-saving AC developing bias VAr, a reference period count M is set to be greater than a special period count N (M>N), where the reference period count M is defined as the number of developing bias periods T (reference periods Ts) within the reference output period Z0, and the special period count N is defined as the number of developing bias periods T (reference periods Ts) within the special output period Z1.

Next, an image forming operation in normal mode and an image forming operation in power saving mode according to Exemplary Embodiment 1 will be described in more detail.

Figure 6:
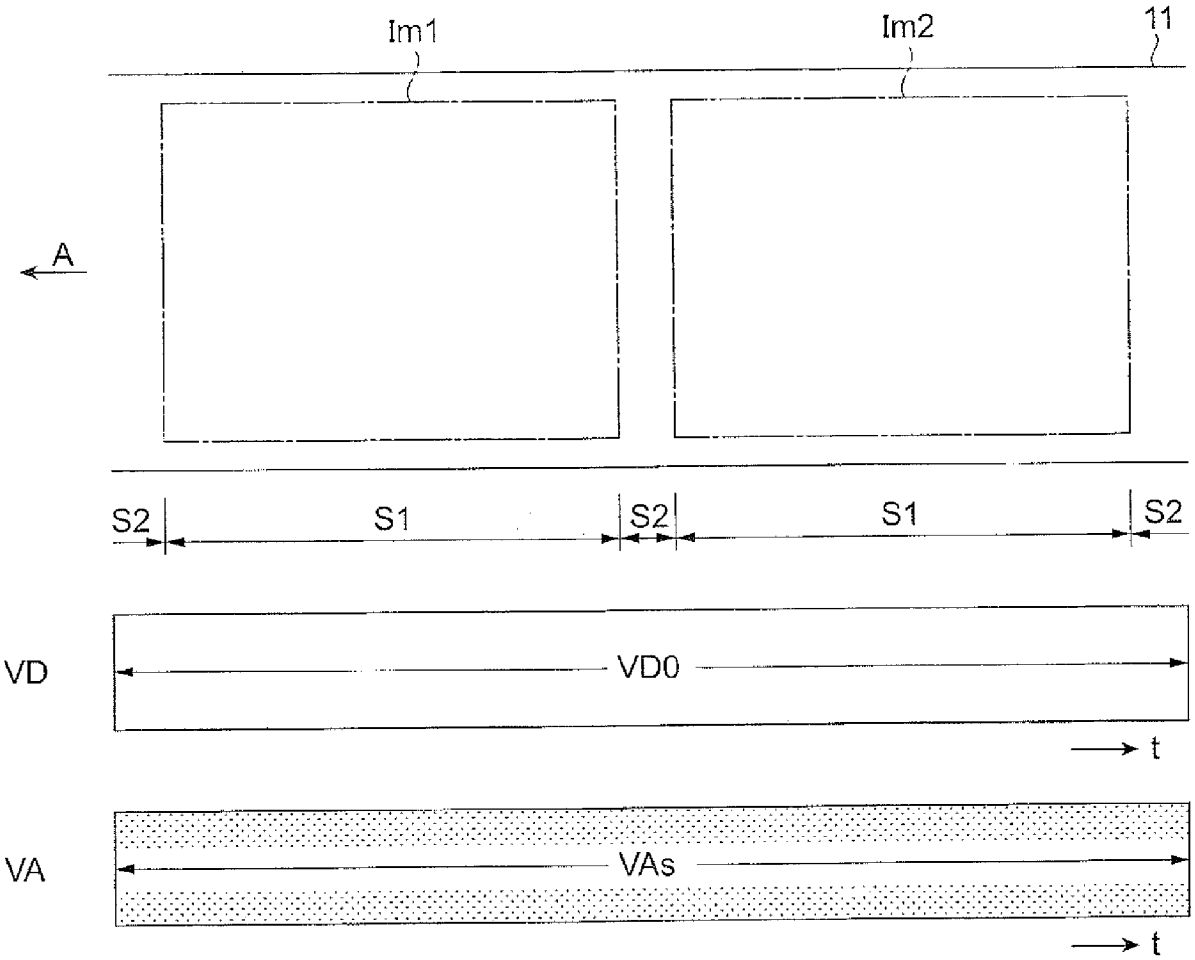
FIG. 6 is a timing chart illustrating an example of how a developing bias is set in the case of successively performing an image forming operation on multiple sheets of paper in normal mode according to Exemplary Embodiment 1.
Figure 7:
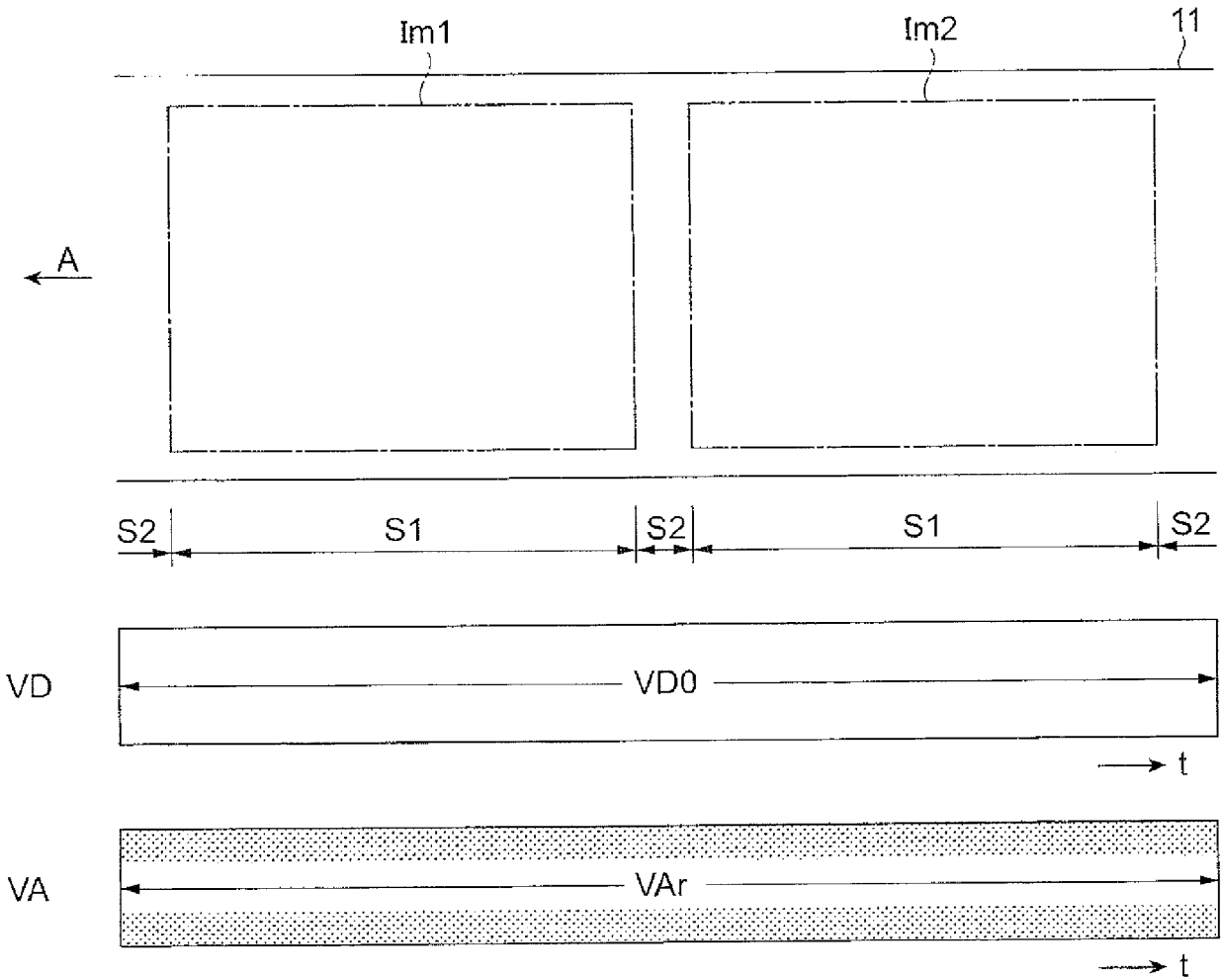
FIG. 7 is a timing chart illustrating an example of how a developing bias is set in the case of successively performing an image forming operation on multiple sheets of paper in power saving mode according to Exemplary Embodiment 1.

FIG. 6 is a timing chart illustrating an example of how the developing bias (including the DC developing bias VD and the AC developing bias VA) is set in the case of successively performing an image forming operation on multiple sheets of paper P in normal mode according to Exemplary Embodiment 1. FIG. 7 is a timing chart illustrating an example of how the developing bias (including the DC developing bias VD and the AC developing bias VA) is set in the case of successively performing an image forming operation on multiple sheets of paper P in power saving mode according to Exemplary Embodiment 1. FIGS. 6 and 7 each illustrate a case in which images corresponding to two consecutive sheets of paper P are sequentially formed on the outer peripheral surface of the photoconductor drum 11. In the following description, with respect to the direction of movement (direction of the arrow A) of the photoconductor drum 11, a region where an image to be transferred to the paper P can be formed will be referred to as image region S1, and a region located between the image region S1 and the next image region S1 will be referred to as inter-image region S2. Further, in the following description, an image formed in the image region S1 corresponding to the first sheet of paper P will be referred to as first image Im1, and an image formed in the image region S1 corresponding to the second sheet of paper P will be referred to as second image Im2.

It is assumed in this example that the charging potential VH is set to −750 V, and the exposure potential VL is set to −300 V. It is also assumed that the DC reference value VD0, which represents the magnitude of the DC developing bias VD, is set to −600 V, the AC reference value VA0 of the AC developing bias VA is set to 800 V, and the AC special value VA1 of the AC developing bias VA is set to 400 V. Further, it is assumed that the reference period count M in the reference output period Z0 is set to 500, and the special period count N in the special output period Z1 is set to 250. Furthermore, it is assumed that the reference frequency fs of the AC developing bias VA is set to 9 kHz, and its duty ratio is set to 0.65.

First, the normal mode illustrated in FIG. 6 will be described.

While an image forming operation is executed in normal mode, the DC developing bias VD is set to the DC reference value VD0=−600 V. That is, in normal mode, the same DC developing bias VD (DC reference value VD0) is supplied irrespective of whether an area on the photoconductor drum 11 which passes through the developing region is the image region S1 or the inter-image region S2.

While an image forming operation is executed in normal mode, the AC developing bias VA is set to the normal AC developing bias VAs (see FIG. 5A) for which the AC reference value VA0=800 V is supplied at all times. That is, in normal mode, the same AC developing bias VA (normal AC developing bias VAS) is supplied irrespective of whether an area on the photoconductor drum 11 which passes through the developing region is the image region S1 or the inter-image region S2.

Next, the power saving mode illustrated in FIG. 7 will be described.

While an image forming operation is executed in power saving mode, the DC developing bias VD is set to the DC reference value VD0=−600 V. That is, in power saving mode, the same DC developing bias VD (DC reference value VD0) is supplied irrespective of whether an area on the photoconductor drum 11 which passes through the developing region is the image region S1 or the inter-image region S2.

While an image forming operation is executed in power saving mode, the AC developing bias VA is set to the power-saving AC developing bias VAr (see FIG. 5B) for which the AC reference value VA0=800 V and the AC special value VA1=400 V are alternately supplied. That is, in power saving mode, the same AC developing bias VA (power-saving AC developing bias VAr) is supplied irrespective of whether an area on the photoconductor drum 11 which passes through the developing region is the image region S1 or the inter-image region S2.

As described above, in Exemplary Embodiment 1, the same DC developing bias VD (DC reference value VD0) is supplied when an image forming operation is performed, irrespective of whether the developing mode is the normal mode or the power saving mode. Further, in Exemplary Embodiment 1, when an image forming operation is to be executed in normal mode, the normal AC developing bias VAs is supplied as the AC developing bias VA, and when an image forming operation is to be executed in power saving mode, the power-saving AC developing bias VAr is supplied as the AC developing bias VA.

Further, in Exemplary Embodiment 1, when an image forming operation is to be executed in normal mode, the DC reference value VD0 is supplied as the DC developing bias VD at all times, and the normal AC developing bias VAs is supplied as the AC developing bias VA. Furthermore, in Exemplary Embodiment 1, when an image forming operation is to be executed in power saving mode, the DC reference value VD0 is supplied as the DC developing bias VD at all times, and the power-saving AC developing bias VAr is supplied as the AC developing bias VA.

An image forming operation is executed under the conditions mentioned above, and as a result, no noticeable difference in image quality is visually observed between an image formed on the paper P by an image forming operation in normal mode, and an image formed on the paper P by an image forming operation in power saving mode.

Further, an image forming operation is executed under the conditions mentioned above, and as a result, the power consumption of the AC developing power supply 1142 in normal mode is 1.92 W, whereas the power consumption of the AC developing power supply 1142 in power saving mode is 1.66 W. That is, by executing an image forming operation in power saving mode, a reduction in power consumption of about 13.5% is achieved in comparison to when an image forming operation is executed in normal mode.

Figure 8:
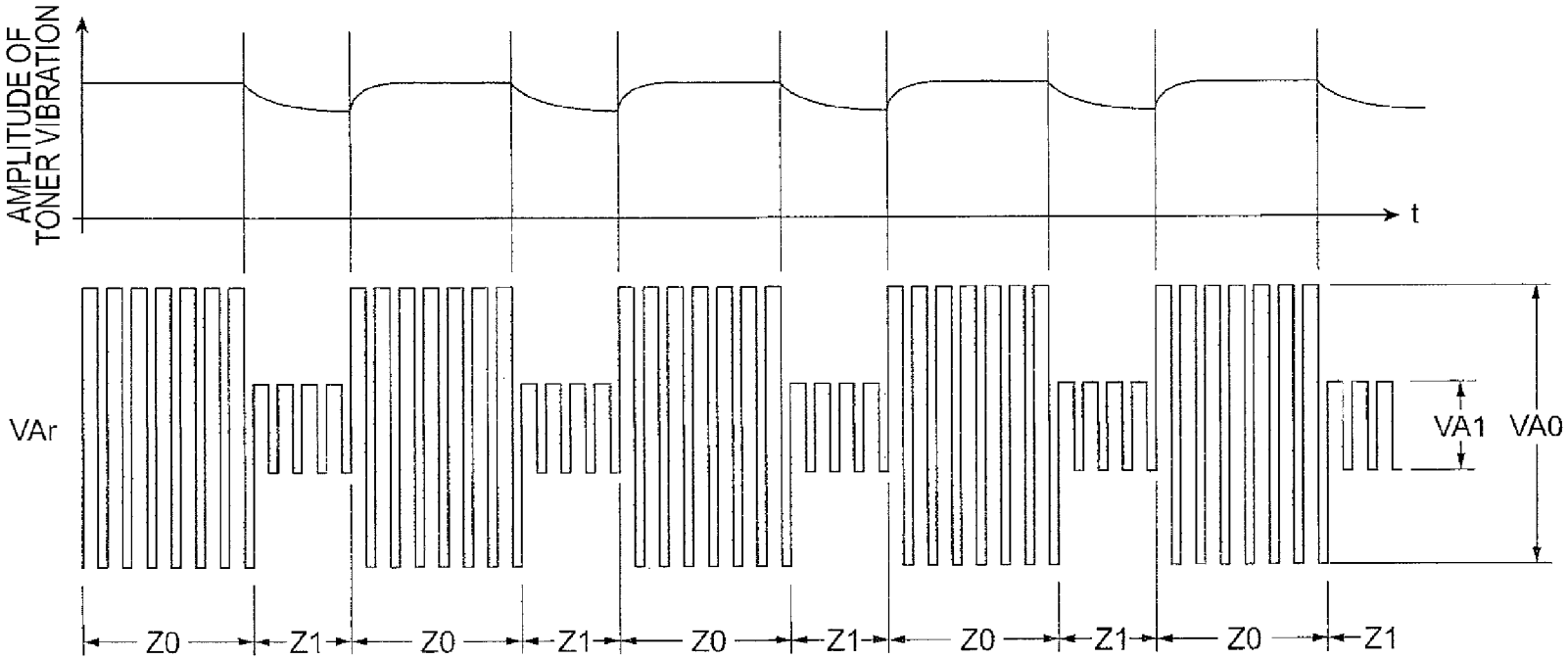
FIG. 8 illustrates the relationship between a power-saving AC developing bias, and the amplitude of vibration of toner in a developing region according to Exemplary Embodiment 1.

FIG. 8 illustrates the relationship between the power-saving AC developing bias VAr used in power saving mode, and the amplitude of vibration of toner in the developing region where the photoconductor drum 11 and the developing roller 14*a* are opposed to each other. In FIG. 8, the horizontal axis represents elapse of time t, and the vertical axis represents the waveform (bottom plot) of the power-saving AC developing bias VAr and the amplitude of vibration of toner (top plot).

As illustrated in FIG. 8, when a configuration is adopted in which, as the power-saving AC developing bias VAr, supply of the AC reference value VA0 in the reference output period Z0 and supply of the AC special value VA1 in the special output period Z1 are alternately performed, the amplitude of vibration of toner in the special output period Z1 is smaller than that in the reference output period Z0. However, in the special output period Z1, the amplitude of vibration of toner does not become immediately small after the end of the reference output period Z0 but becomes gradually smaller in an exponential manner with the elapse of time t. Consequently, even if a configuration is adopted which supplies the power-saving AC developing bias VAr as illustrated in the bottom plot of FIG. 8, the influence of such a configuration on the vibration of toner is relatively small in comparison to when the normal AC developing bias VAs is supplied in normal mode. This is considered to be the reason for the small difference in image quality between an image formed on the paper P by an image forming operation in normal mode, and an image formed on the paper P by an image forming operation in power saving mode.

Exemplary Embodiment 2

In Exemplary Embodiment 1, a configuration is adopted in which, as the power-saving AC developing bias VAr used in power saving mode, supply of the AC reference value VA0 in the reference output period Z0 and supply of the AC special value VA1 in the special output period Z1 are alternately performed. In other words, in Exemplary Embodiment 1, the power-saving AC developing bias VAr is of two values (the AC reference value VA0 and the AC special value VA1). In contrast, in Exemplary Embodiment 2, the power-saving AC developing bias VAr is multi-valued. In Exemplary Embodiment 2, components or features similar to those in Exemplary Embodiment 1 are denoted by the same reference signs, and a detailed description of those components or features is omitted.

The developing mode according to Exemplary Embodiment 2 will be described below in more detail.

Figure 9A:
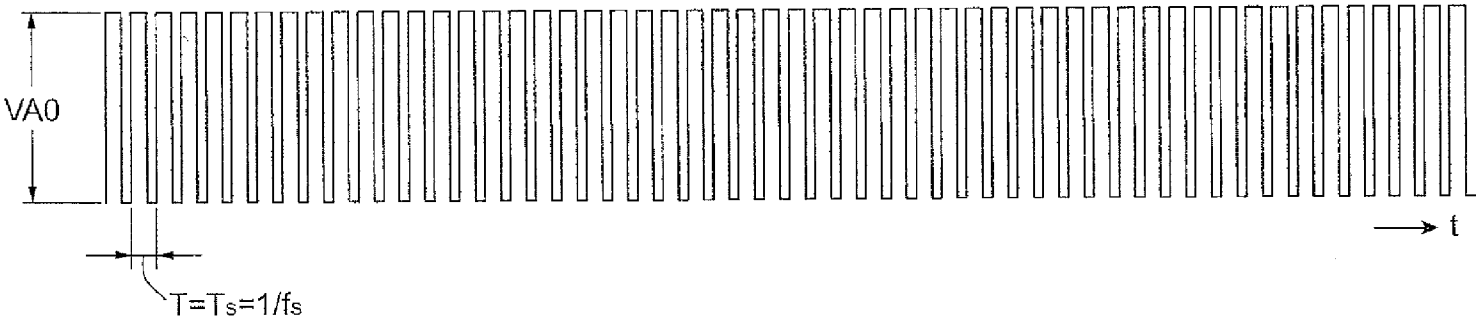
FIG. 9A illustrates an example of a waveform of a normal AC developing bias used as an AC developing bias in normal mode according to Exemplary Embodiment 2.
Figure 9B:
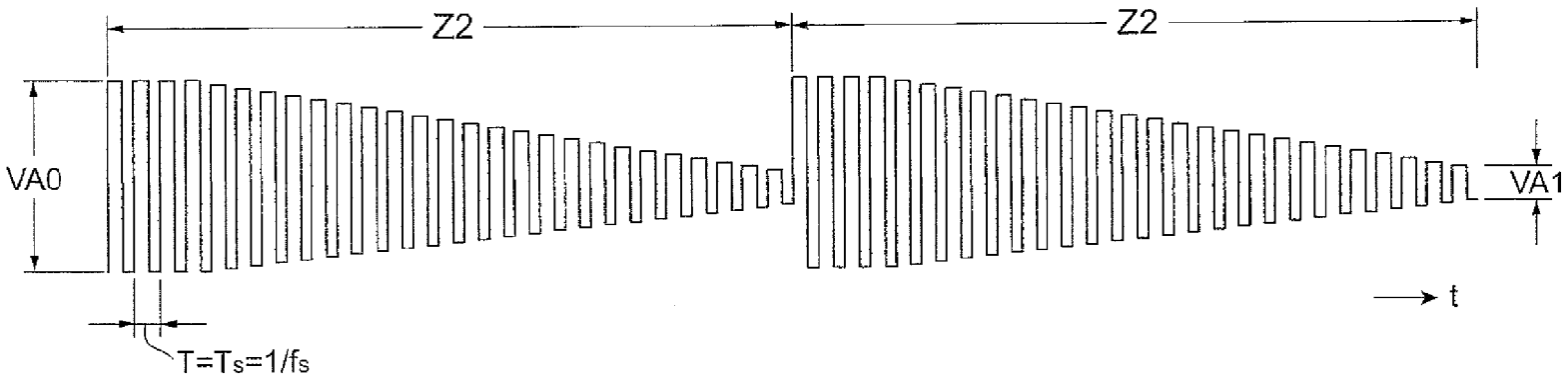
FIG. 9B illustrates an example of a waveform of a power-saving AC developing bias used as an AC developing bias in power saving mode according to Exemplary Embodiment 2.

FIG. 9A illustrates an example of a waveform of a normal AC developing bias VAs used as the AC developing bias VA in normal mode according to Exemplary Embodiment 2. FIG. 9B illustrates an example of a waveform of a power-saving AC developing bias VAr used as the AC developing bias VA in power saving mode according to Exemplary Embodiment 2. In FIGS. 9A and 9B, the horizontal axis represents elapse of time t, and the vertical axis represents the magnitude (peak-to-peak value) of the AC developing bias VA.

The normal AC developing bias VAs illustrated in FIG. 9A is the same as that described above with reference to Exemplary Embodiment 1 (see FIG. 5A). That is, the normal AC developing bias VAs illustrated in FIG. 9A is formed by a rectangular wave with a peak-to-peak value that is uniformly set to the AC reference value VA0. Further, the developing bias period T of the normal AC developing bias VAs is set to the reference period Ts, and the developing bias frequency f is the reference frequency fs.

Next, the power-saving AC developing bias VAr will be described with reference to FIG. 9B.

In the power-saving AC developing bias VAr illustrated in FIG. 9B, a decay output period Z2 is repeated. In the decay output period Z2, a rectangular wave whose peak-to-peak value is set to decrease sequentially from the AC reference value VA0 to the AC special value VA1 is output. The developing bias period T of the power-saving AC developing bias VAs is set to the reference period Ts. As a result, the developing bias frequency f of the normal AC developing bias VAs is also the reference frequency fs that is the reciprocal of the reference period Ts.

In this example as well, it is assumed that the charging potential VH is set to −750 V, and the exposure potential VL is set to −300 V. It is also assumed that the DC reference value VD0, which represents the magnitude of the DC developing bias VD, is set to −600 V, the AC reference value VA0 of the AC developing bias VA is set to 800 V, and the AC special value VA1 of the AC developing bias VA is set to 400 V. Further, it is assumed that the reference frequency fs of the AC developing bias VA is set to 9 kHz, and its duty ratio is set to 0.65.

In Exemplary Embodiment 2, for example, during an image forming operation in normal mode illustrated in FIG. 6, the normal AC developing bias VAs illustrated in FIG. 9A is used. Further, in Exemplary Embodiment 2, for example, during an image forming operation in power saving mode illustrated in FIG. 7, the power-saving AC developing bias VAr illustrated in FIG. 9B is used.

In Exemplary Embodiment 2, a rectangular wave whose peak-to-peak value is set to decrease sequentially from the AC reference value VA0 to the AC special value VA1 is output as the power-saving AC developing bias VAr. However, this is not to be construed restrictively. For example, a rectangular wave whose peak-to-peak value is set to increase sequentially from the AC special value VA1 to the AC reference value VA0 may be output as the power-saving AC developing bias VAr. Further, the waveform pattern of the power-saving AC developing bias VAr is not limited to one in which the peak-to-peak value gradually decreases or gradually increases, as long as the waveform pattern used has multiple peak-to-peak values.

Exemplary Embodiment 3

In Exemplary Embodiments 1 and 2, designation of the normal mode or the power saving mode is received from the user, and the AC developing bias VA to be supplied is made to differ between the normal mode and the power saving mode. In contrast, in Exemplary Embodiment 3, the kind of the AC developing bias VA to be supplied is set in accordance with the type of an image formed on the photoconductor drum 11. In Exemplary Embodiment 3, components or features similar to those in Exemplary Embodiments 1 and 2 are denoted by the same reference signs, and a detailed description of those components or features is omitted.

Figure 10:
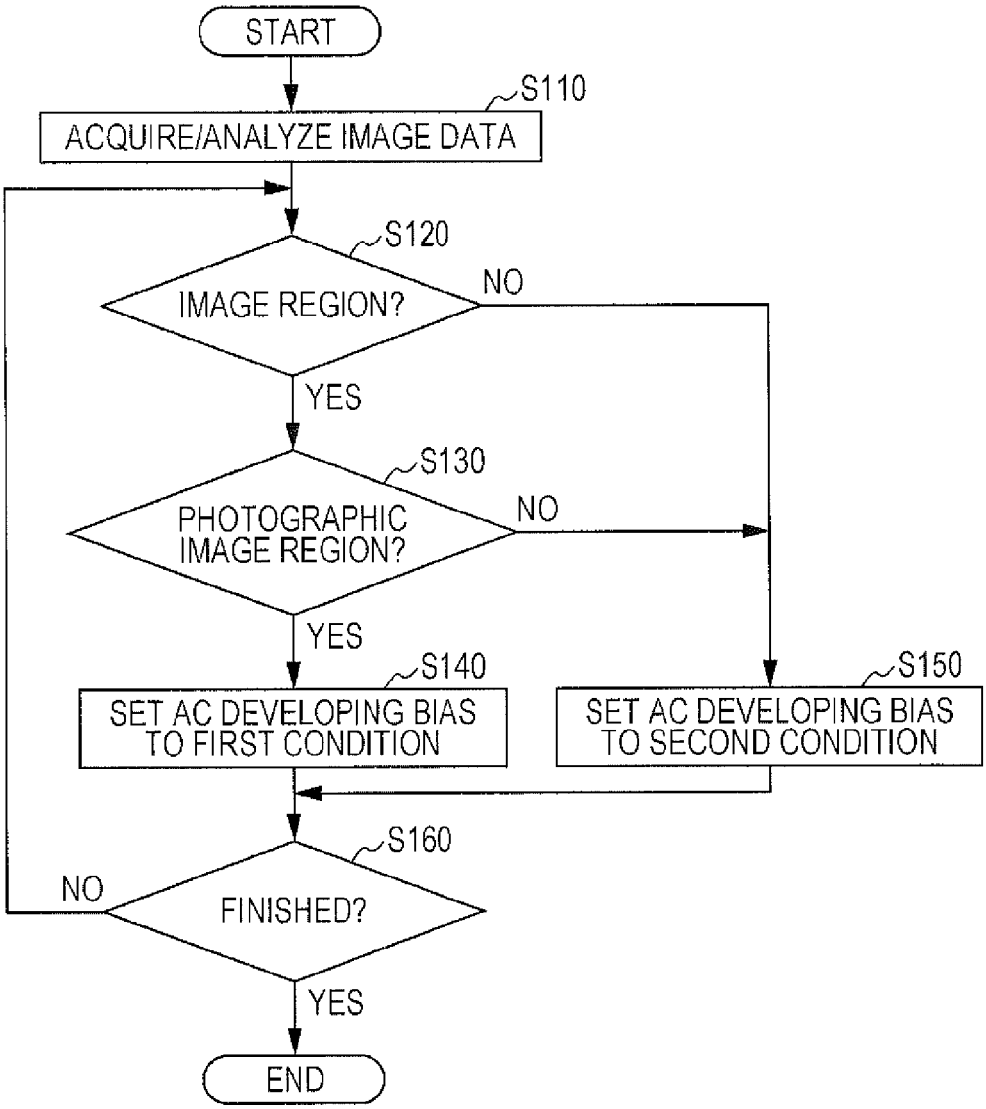
FIG. 10 is a flowchart illustrating a procedure for setting a developing condition in an image forming operation according to Exemplary Embodiment 3.

FIG. 10 is a flowchart illustrating a procedure for setting a developing condition in an image forming operation according to Exemplary Embodiment 3.

In this process, first, the controller 100 acquires image data input from the image processing part 40, and analyzes the acquired image data (step 110). At step 110, the controller 100 analyzes the acquired image data to determine whether an image to be formed is a photographic image represented by multiple values (multivalued image) or a character image represented by two values (binary image). Next, the controller 100 determines if an area on the outer peripheral surface of the photoconductor drum 11 which is about to pass through the developing region (an area subject to development) is the image region S1 (step 120). If a positive determination (YES) is made at step 120, the controller 100 determines, by using the results of the analysis at step 110, if an area on the outer peripheral surface of the photoconductor drum 11 which is about to pass through the developing region is a photographic image region where a photographic image is to be formed (step 130). If a positive determination (YES) is made at step 130, the controller 100 outputs, to the AC developing power supply 1142, an instruction for setting the AC developing bias VA to a first condition C1 (step 140), and proceeds to step 160.

If a negative determination (NO) is made at step 120, that is, if an area on the outer peripheral surface of the photoconductor drum 11 which is about to pass through the developing region is the inter-image region S2, the controller 100 outputs, to the AC developing power supply 1142, an instruction for setting the AC developing bias VA to a second condition C2 (step 150), and proceeds to step 160. Further, if a negative determination (NO) is made at step 130, that is, if an area on the outer peripheral surface of the photoconductor drum 11 which is about to pass through the developing region is a character image region where a character image is to be formed, the controller 100 outputs, to the AC developing power supply 1142, an instruction for setting the AC developing bias VA to the second condition C2 (step 150), and proceeds to step 160.

Then, the controller 100 determines if an image forming operation has been finished, in other words, if an exposure operation based on the image data acquired at step 110 has been completed (step 160). If a positive determination (YES) is made at step 160, this image forming operation is completed. If a negative determination (NO) is made at step 160, the controller 100 returns to step 120 and continues the subsequent processing.

The first condition C1 and the second condition C2 according to Exemplary Embodiment 3 will be described in more detail below.

Figure 11A:
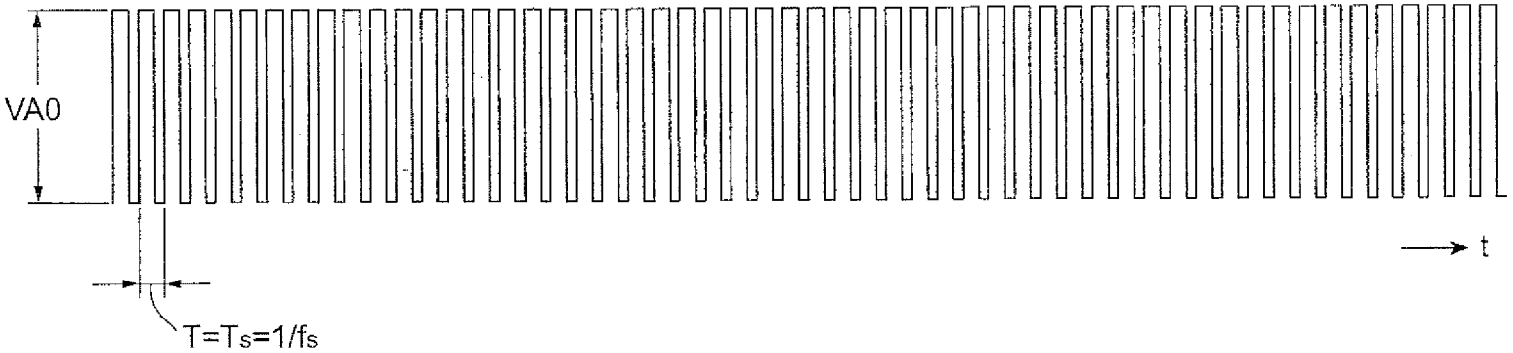
FIG. 11A illustrates an example of a waveform of an AC developing bias corresponding to a first condition according to Exemplary Embodiment 3.
Figure 11B:
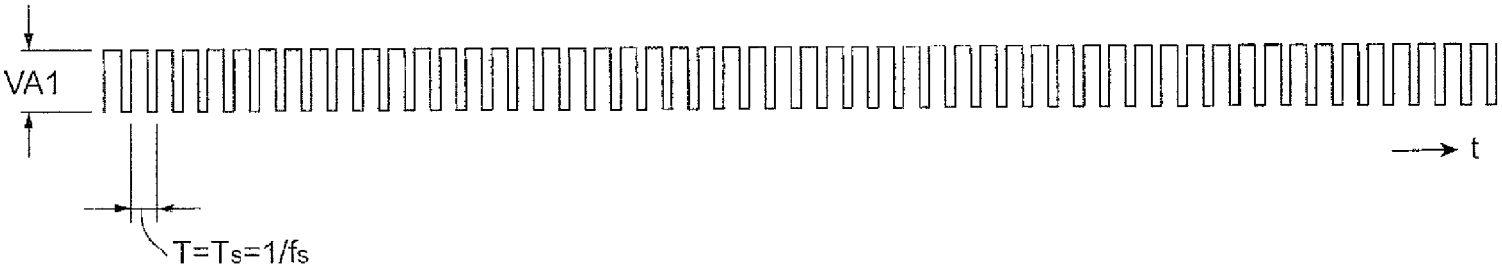
FIG. 11B illustrates an example of a waveform of an AC developing bias corresponding to a second condition according to Exemplary Embodiment 3.

FIG. 11A illustrates an example of a waveform of the AC developing bias VA corresponding to the first condition C1 according to Exemplary Embodiment 3. FIG. 11B illustrates an example of a waveform of the AC developing bias VA corresponding to the second condition C2 according to Exemplary Embodiment 3. In FIGS. 11A and 11B, the horizontal axis represents elapse of time t, and the vertical axis represents the magnitude (peak-to-peak value) of the AC developing bias VA.

First, the first condition C1 according to Exemplary Embodiment 3 will be described with reference to FIG. 11A.

According to the first condition C1 illustrated in FIG. 11A, the AC developing bias VA is formed by a rectangular wave with a peak-to-peak value that is uniformly set to the AC reference value VA0. The developing bias period T according to the first condition C1 is set to the reference period Ts. As a result, the developing bias frequency f according to the first condition C1 is the reference frequency fs that is the reciprocal of the reference period Ts.

Next, the second condition C2 according to Exemplary Embodiment 3 will be described with reference to FIG. 11B.

According to the second condition C2 illustrated in FIG. 11B, the AC developing bias VA is formed by a rectangular wave with a peak-to-peak value that is uniformly set to the AC special value VA1. As in Exemplary Embodiment 1 and the like, the AC reference value VA0 and the AC special value VA1 have the following relationship: VA0 >VA1. The developing bias period T according to the second condition C2 is set to the reference period Ts. As a result, the developing bias frequency f according to the second condition C2 is the reference frequency fs that is the reciprocal of the reference period Ts.

An image forming operation according to Exemplary Embodiment 3 will be described below in more detail.

Figure 12:
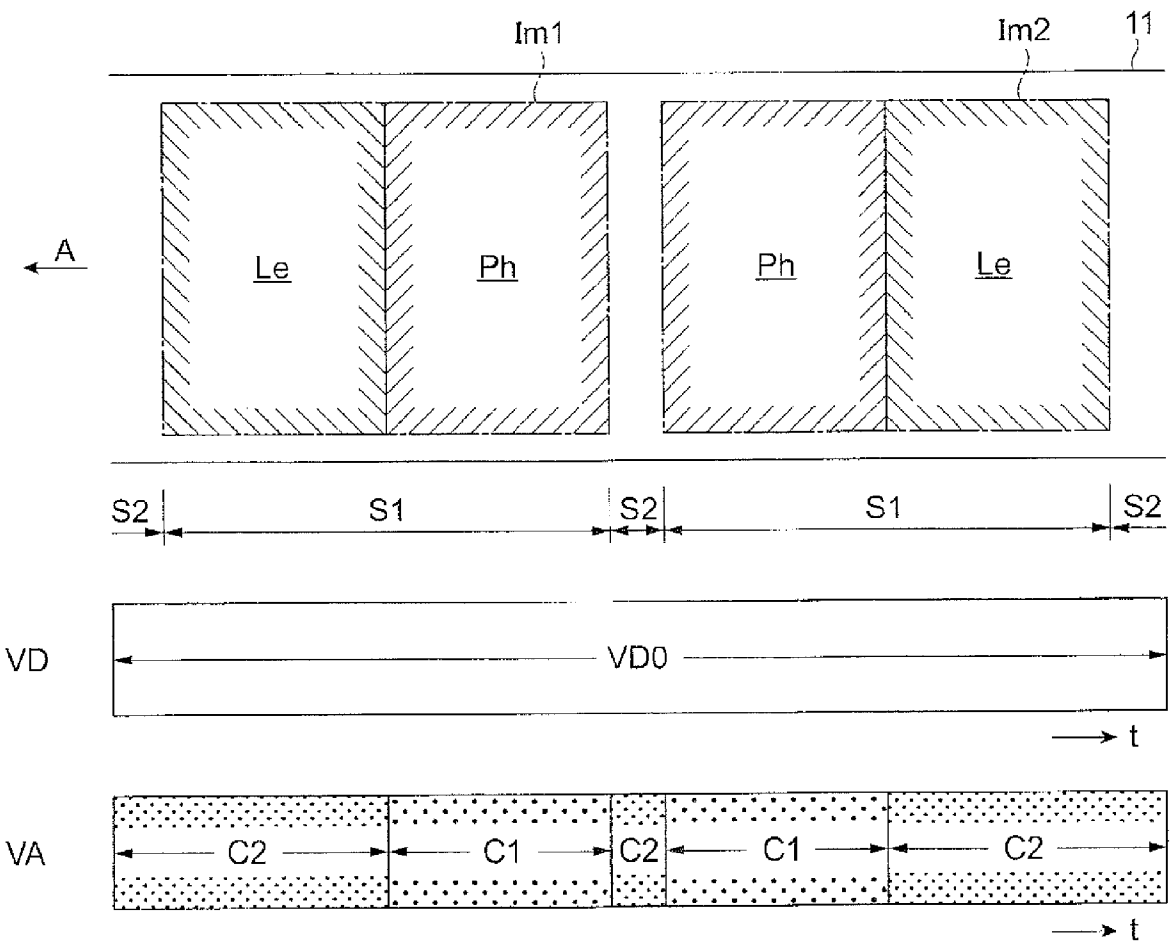
FIG. 12 is a timing chart illustrating an example of how a developing bias is set in the case of successively performing an image forming operation on multiple sheets of paper according to Exemplary Embodiment 3.

FIG. 12 is a timing chart illustrating an example of how the developing bias (including the DC developing bias VD and the AC developing bias VA) is set in the case of successively performing an image forming operation on multiple sheets of paper P according to Exemplary Embodiment 3. FIG. 12 illustrates a case in which images corresponding to two consecutive sheets of paper P are sequentially formed on the outer peripheral surface of the photoconductor drum 11. In this example, in the first image Im1 corresponding to the first sheet of paper P, a character image region Le on which to form a character image is located at a position on the leading edge side in the direction of the arrow A, and a photographic image region Ph on which to form a photographic image is located at a position on the trailing edge side which follows the character image region Le. Further, in this example, in a second image Im2 corresponding to the second sheet of paper P, the photographic image region Ph is located at a position on the leading edge side in the direction of the arrow A, and the character image region Le is located at a position on the trailing edge side which follows the photographic image region Ph.

It is assumed in this example that the charging potential VH is set to −750 V, and the exposure potential VL is set to −300 V. It is also assumed that the DC reference value VD0 of the DC developing bias VD is set to −600 V, the AC reference value VA0 of the AC developing bias VA is set to 800 V, and the AC special value VA1 of the AC developing bias VA is set to 400 V. Further, it is assumed that the reference frequency fs of the AC developing bias VA is set to 9 kHz, and its duty ratio is set to 0.65.

In this example, while an image forming operation is executed in normal mode, the DC developing bias VD is set to the DC reference value VD0=−600 V. That is, in Exemplary Embodiment 3, the same DC developing bias VD (the DC reference value VD0) is supplied irrespective of whether an area on the photoconductor drum 11 which passes through the developing region is the image region S1 or the inter-image region S2.

In this example, if an area on the photoconductor drum 11 which passes through the developing region is the image region S1 and the photographic image region Ph, the AC developing bias VA is set to the first condition C1. Further, in this example, if an area on the photoconductor drum 11 which passes through the developing region is the image region S1 and the character image region Le, and if this area is the inter-image region S2, the AC developing bias VA is set to the second condition C2. That is, in Exemplary Embodiment 3, even when an area on the photoconductor drum 11 which passes through the developing region is the image region S1, the AC developing bias VA (the first condition C1 or the second condition C2) to be supplied differs depending on whether the area is the photographic image region Ph or the character image region Le.

This is explained more specifically below. In the example illustrated in FIG. 12, the second condition C2 is set for the first inter-image region S2 located on the most upstream side (the left end side in FIG. 12), and for the character image region Le within the image region S1 of the first image Im1 which follows the first inter-image region S2. The first condition C1 is set for the photographic image region Ph within the image region S1 of the first image Im1 which follows the character image region Le mentioned above. Further, the second condition C2 is set for the second inter-image region S2 that follows the photographic image region Ph mentioned above. Furthermore, the first condition C1 is set for the photographic image region Ph within the image region S1 of the second image Im2 which follows the second inter-image region S2. Then, the second condition C2 is set for the character image region Le within the image region S1 of the second image Im2 which follows the photographic image region Ph mentioned above, and for the third inter-image region S2 located on the most downstream side (the right end side in FIG. 12).

As described above, in Exemplary Embodiment 3, the same DC developing bias VD (the DC reference value VD0) is supplied when an image forming operation is performed for both the image region S1 and the inter-image region S2. Further, in Exemplary Embodiment 3, while an image forming operation is executed, when the image region S1 passes through the developing region, the first condition C1 or the second condition C2 is set for the AC developing bias VA, and when the inter-image region S2 passes through the developing region, the second condition C2 is set for the AC developing bias VA. At this time, in Exemplary Embodiment 3, when the photographic image region Ph within the image region S1 passes through the developing region, the first condition C1 is set for the AC developing bias VA, and when the character image region Le within the image region S1 passes through the developing region, the second condition C2 is set for the AC developing bias VA.

An image forming operation is executed under the developing conditions mentioned above, and as a result, no noticeable difference in image quality is visually observed between an image (photographic image) of the photographic image region Ph within the image region S1 which is developed in accordance with the first condition C1, and an image (character image) of the character image region Le within the image region S1 which is developed in accordance with the second condition C2.

Further, an image forming operation is executed under the developing conditions mentioned above, and as a result, the power consumption of the AC developing power supply 1142 is reduced in comparison to when the developing condition is set to the first condition C1 at all times.

Exemplary Embodiment 4

In Exemplary Embodiment 3, the magnitude (peak-to-peak value) of the AC developing bias VA differs but the developing bias period T is the same between the first condition C1 and the second condition C2. In contrast, in Exemplary Embodiment 4, both the magnitude of the AC developing bias VA and the developing bias period T differ between the first condition C1 and the second condition C2. In Exemplary Embodiment 4, components or features that are similar to those in Exemplary Embodiment 3 are denoted by the same reference signs, and a detailed description of those components or features is omitted.

The first condition C1 and the second condition C2 according to Exemplary Embodiment 4 will be described in more detail below.

Figure 13A:
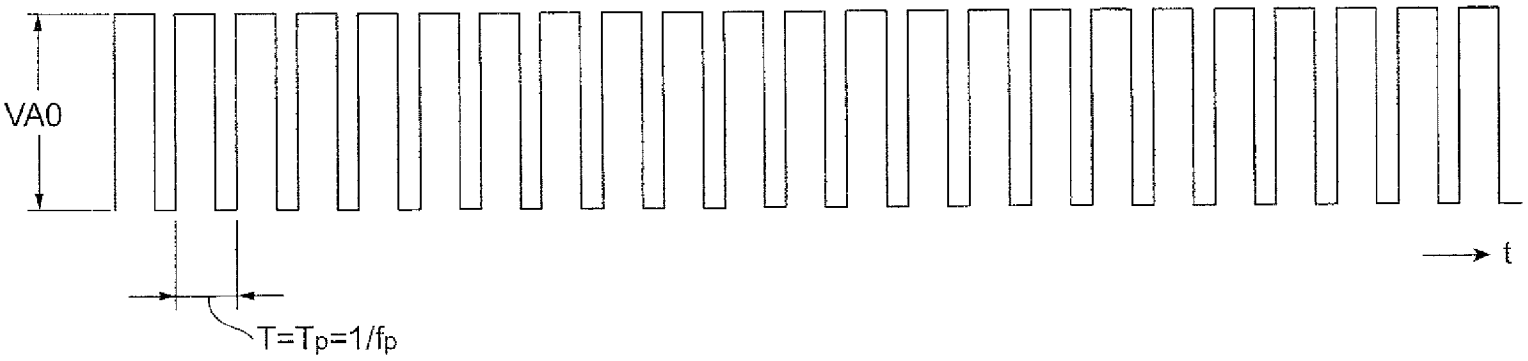
FIG. 13A illustrates an example of a waveform of an AC developing bias corresponding to a first condition according to Exemplary Embodiment 4.
Figure 13B:
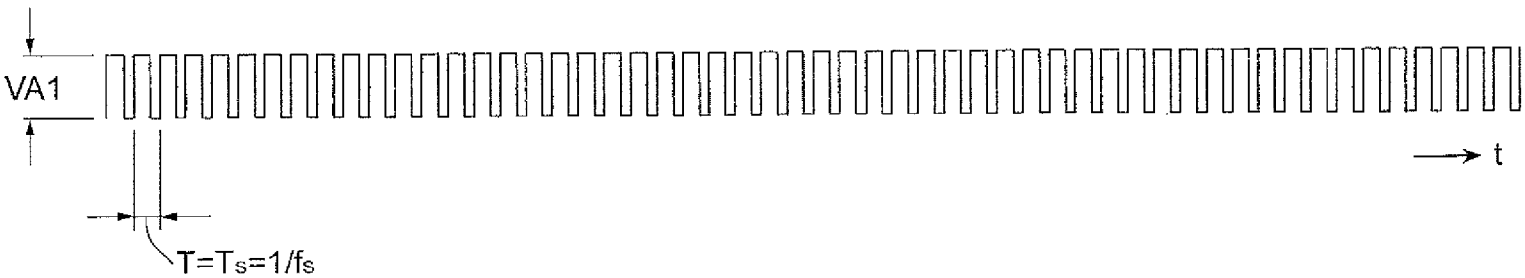
FIG. 13B illustrates an example of a waveform of an AC developing bias corresponding to a second condition according to Exemplary Embodiment 4.

FIG. 13A illustrates an example of a waveform of the AC developing bias VA corresponding to the first condition C1 according to Exemplary Embodiment 4. FIG. 13B illustrates an example of a waveform of the AC developing bias VA corresponding to the second condition C2 according to Exemplary Embodiment 4. In FIGS. 13A and 13B, the horizontal axis represents elapse of time t, and the vertical axis represents the magnitude (peak-to-peak value) of the AC developing bias VA.

First, the first condition C1 according to Exemplary Embodiment 4 will be described with reference to FIG. 13A.

According to the first condition C1 illustrated in FIG. 13A, the AC developing bias VA is formed by a rectangular wave with a peak-to-peak value that is uniformly set to the AC reference value VA0. However, the developing bias period T according to the first condition C1 is set to a special period Tp (an example of a first period) that is longer than the reference period Ts. As a result, the developing bias frequency f according to the first condition C1 is a special frequency fp, which is the reciprocal of the special period Tp and lower than the reference frequency fs.

Next, the second condition C2 according to Exemplary Embodiment 4 will be described with reference to FIG. 13B.

The second condition C2 illustrated in FIG. 13B is the same as that described above with reference to Exemplary Embodiment 3 (see FIG. 11B). That is, according to the second condition C2 illustrated in FIG. 13B, the AC developing bias VA is formed by a rectangular wave with a peak-to-peak value that is uniformly set to the AC special value VA1. Further, the developing bias period T according to the second condition C2 is set to the reference period Ts (an example of a second period), and the developing bias frequency f is the reference frequency fs.

In this example as well, it is assumed that the charging potential VH is set to −750 V, and the exposure potential VL is set to −300 V. It is also assumed that the DC reference value VD0, which represents the magnitude of the DC developing bias VD, is set to −600 V, the AC reference value VA0 of the AC developing bias VA is set to 800 V, and the AC special value VA1 of the AC developing bias VA is set to 400 V. Further, it is assumed that the reference frequency fs of the AC developing bias VA according to the first condition C1 is set to 9 kHz, and its duty ratio is set to 0.65. Further, it is assumed that the special frequency fp of the AC developing bias VA according to the second condition C2 is set to 4.5 kHz, and its duty ratio is set to 0.65.

In Exemplary Embodiment 4, for example, during the image forming operation illustrated in FIG. 12, the AC developing bias VA illustrated in FIG. 13A is used as the first condition C1, and the AC developing bias VA illustrated in FIG. 13B is used as the second condition C2.

While Exemplary Embodiments 1 to 4 are directed to a case in which a two-component developer is used as a developer, this is not to be construed restrictively. For example, as a developer, a mono-component developer that does not include carrier may be used. In this case, the mono-component developer may be either a magnetic mono-component developer having magnetic property, or a non-magnetic mono-component developer that does not have magnetic property.

While Exemplary Embodiments 1 to 4 are directed to an example of the image forming apparatus 1 that forms a single-color toner image, this is not to be construed restrictively. For example, exemplary embodiments of the invention may be applied to an image forming apparatus of a so-called tandem type which includes multiple image forming units each having components such as a photoconductor drum and a developing device, or an image forming apparatus of a so-called four-cycle type which includes a single photoconductor drum and multiple developing devices (for example, for four colors).

Further, while Exemplary Embodiments 1 and 2 are directed to a case in which, in power saving mode, the power-saving AC developing bias VAr is supplied for both the image region S1 and the inter-image region S2, this is not to be construed restrictively. For example, an alternative arrangement may be employed in which, in power saving mode, the power-saving AC developing bias VAr is supplied to the image region S1, and only the AC special value VA1 (corresponding to the second condition C2 in Exemplary Embodiments 3 and 4) is supplied to the inter-image region S2.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image carrier;

a developing part that develops an electrostatic latent image formed on the image carrier by using toner;

a supply part that supplies a developing bias between the image carrier and the developing part, the developing bias having an AC component superimposed on a DC component; and a setting part that sets a peak-to-peak value of the AC component of the developing bias to vary between a reference value at a first frequency, the reference value being determined in advance, and a special value at a second frequency, the special value being smaller than the reference value when an image region on the image carrier passes through a developing region, the second frequency being less than the first frequency, the image region being a region on the image carrier in which an image is to be formed, and the developing region being a region in which the image carrier is opposed to the developing part.

2. The image forming apparatus according to claim 1, wherein the setting part sets a magnitude of the DC component of the developing bias to a fixed value when the image region on the image carrier passes through the developing region.

3. The image forming apparatus according to claim 2, wherein the setting part sets the AC component of the developing bias to alternate between a reference output period and a special output period when the image region on the image carrier passes through the developing region, the reference output period being a period in which the peak-to-peak value of the AC component is set to the reference value, the special output period being a period in which the peak-to-peak value of the AC component is set to the special value.

4. The image forming apparatus according to claim 1, wherein the setting part sets the AC component of the developing bias to alternate between a reference output period and a special output period when the image region on the image carrier passes through the developing region, the reference output period being a period in which the peak-to-peak value of the AC component is set to the reference value, the special output period being a period in which the peak-to-peak value of the AC component is set to the special value.

5. The image forming apparatus according to claim 1, wherein the setting part sets the peak-to-peak value of the AC component of the developing bias to a value smaller than the reference value when an inter-image region on the image carrier passes through the developing region, the inter-image region being a region located between the image region and the image region on the image carrier.

6. An image forming apparatus comprising:

an image carrier;

a developing part that develops an electrostatic latent image formed on the image carrier by using toner;

a supply part that supplies a developing bias between the image carrier and the developing part, the developing bias having an AC component superimposed on a DC component; and a setting part that sets a peak-to-peak value of the AC component of the developing bias to one of a first mode and a second mode, the first mode being a mode in which the peak-to-peak value is set to a reference value at a first frequency, the reference value being determined in advance, the second mode being a mode in which the peak-to-peak value is varied between the reference value and a special value at a second frequency, the special value being smaller than the reference value, and the second frequency being less than the first frequency.

7. The image forming apparatus according to claim 6, wherein the setting part sets a magnitude of the DC component of the developing bias to a fixed value in each of the first mode and the second mode.

8. An image forming apparatus comprising:

an image carrier;

a developing part that develops an electrostatic latent image formed on the image carrier by using toner;

a supply part that supplies a developing bias between the image carrier and the developing part, the developing bias having an AC component superimposed on a DC component; and a changing part that, depending on a type of the electrostatic latent image formed on the image carrier, changes a peak-to-peak value of the AC component of the developing bias from a reference value that is determined in advance to a special value smaller than the reference value.

9. The image forming apparatus according to claim 8, wherein the changing part sets the peak-to-peak value of the AC component to the reference value if the electrostatic latent image corresponds to a photographic image, and sets the peak-to-peak value of the AC component to the special value if the electrostatic latent image corresponds to a character image.

10. The image forming apparatus according to claim 9, wherein the changing part sets a period of the AC component to a first period if the electrostatic latent image corresponds to a photographic image, and sets the period of the AC component to a second period shorter than the first period if the electrostatic latent image corresponds to a character image.

11. An image forming method comprising:

developing an electrostatic latent image formed on an image carrier by using toner;

supplying a developing bias between the image carrier and a developing part, the developing bias having an AC component superimposed on a DC component; and setting a peak-to-peak value of the AC component of the developing bias to vary between a reference value at a first frequency, the reference value being determined in advance, and a special value at a second frequency, the special value being smaller than the reference value when an image region on the image carrier passes through a developing region, the second frequency being less than the first frequency, the image region being a region on the image carrier in which an image is to be formed, and the developing region being a region in which the image carrier is opposed to the developing part.

* * * * *